United States Patent [19]

Ferguson et al.

[11] Patent Number: 4,611,551

[45] Date of Patent: Sep. 16, 1986

[54] SNORKEL MAST FOR A SEMI-SUBMERSIBLE VEHICLE

[76] Inventors: James S. Ferguson; J. Eric Jackson; Isaac B. Brower-Berkhoven, all of c/o International Submarine Engineering Ltd., 2601 Murray Street, Port Moody, British Columbia, Canada

[21] Appl. No.: 681,683

[22] Filed: Dec. 14, 1984

[51] Int. Cl.[4] ..... B63G 8/04

[52] U.S. Cl. ..... 114/339; 114/212; 137/434

[58] Field of Search ..... 114/312, 326, 327, 334, 114/336, 339, 243, 211, 212; 251/279, 305; 137/440, 448, 434, 445; 440/83

[56] References Cited

U.S. PATENT DOCUMENTS

| | | | |
|---|---|---|---|
| 2,413,350 | 12/1946 | Helmore . | |
| 2,941,492 | 6/1960 | Wilcoxon . | |
| 2,949,089 | 8/1960 | Reid . | |
| 2,949,090 | 8/1960 | Gerber | 114/243 X |
| 3,407,779 | 10/1968 | Satterthwaite | 440/83 X |

FOREIGN PATENT DOCUMENTS

| | | | |
|---|---|---|---|
| 872577 | 6/1971 | Canada . | |
| 942131 | 2/1974 | Canada . | |
| 27912 | of 1908 | United Kingdom | 114/334 |
| 951809 | 6/1961 | United Kingdom | 137/448 |

OTHER PUBLICATIONS

Dolphin: On Trial; K. Malone; Lighthouse: Edition No. 28; Nov., 1983.

Design and Development of a Diesel Powered Semi--Submersible ROV; James S. Ferguson et al.; Mar., 1984.

*Primary Examiner*—Trygve M. Blix
*Assistant Examiner*—Paul E. Salmon
*Attorney, Agent, or Firm*—Wenderoth, Lind & Ponack

[57] ABSTRACT

There is described a snorkel mast for a submersible vehicle. The mast terminates at the upper end in an inverted U-shaped snorkel head pipe section closed by a butterfly valve. The butterfly valve is operated by a bell-crank lever having a float at one end and a water impact flap at the other. Operation of the bell-crank lever by water level action against the float or by water impact action on the flap if a wave washes over the top of the snorkel mast acts to close the butterfly valve. The mast carries a fairing which comprises a number of fairing elements of airfoil cross-section, vertically spaced on the mast so as to be freely rotatable thereon in water lubricated bearings. The segmented fairings on the snorkel mast maintains hydrodynamic stability during high speed turns.

2 Claims, 4 Drawing Figures

SNORKEL MAST FOR A SEMI-SUBMERSIBLE VEHICLE

BACKGROUND OF THE INVENTION

The present invention relates to a snorkel mast, particularly a snorkel mast for a submersible vehicle.

The large areas of offshore continental margin presently being surveyed for the oil industry has led to the use of small craft deployed from a mother ship and provided with adequate power to keep station with it. This is a more cost effective approach than using the mother ship alone. However the crew of such small craft are subject to arduous conditions and operation is often weather limited. It has been suggested to use radio-controlled unmanned vehicles but these gave steering and control problems.

The present approach is to use a remotely controlled, diesel engined, snorkel ventilated, submersible vehicle as the survey platform. Existing technology of snorkel masts of full scale submarines is unsuitable to the smaller robot type craft envisaged. For one thing, the snorkel tube closure valves in use on full size submarines acts too slowly to be fully effective in smaller craft where the size scale is different and further since the snorkel mast of a robot submersible is virtually always above water during operation of the submersible (the snorkel mast doubles as a mounting site for a radio telemetry antenna, a strobe light and a radar transponder) it is necessary to ensure that the snorkel mast will not affect the stability of the surveying platform provided by the submersible vehicle, particularly in turns.

SUMMARY OF THE INVENTION

According to the present invention there is provided a snorkel mast terminating at one end in a snorkel valve mechanism and carrying a fairing comprising a plurality of fairing elements of substantially airfoil cross-section vertically spaced on the mast and mounted so as to be freely rotatable thereon. Preferably the fairing elements are individually freely mounted on the mast in water lubricated bearings.

A streamlined snorkel head cover may be mounted on the mast to substantially encase the snorkel valve mechanism and slot means may be provided in the walls of the cover to pass a snorkel valve actuating means therethrough.

According to a further preferred feature of the invention the valve mechanism may include a valve actuating bell-crank lever having at one end a float mechanism and at the other a water impact flap means whereby the snorkel valve may be closed by the action of water flowing past the valve mechanism or by a float lifting action of water level relative to the float. The central snorkel tube of the snorkel mast may be provided at the mast end remote from the valve mechanism with a water separating device.

According to a further feature of the invention a mast has a fairing comprising a plurality of fairing elements of substantially airfoil cross-section vertically spaced on the mast and mounted so as to be freely rotatable thereon.

According to a further feature of the invention a snorkel valve closure mechanism comprises a valve seating member mounted at the open end of an inverted U-shaped snorkel head pipe section; a butterfly valve pivoted at said open end; a bell-crank lever pivotally mounted on the snorkel head pipe section above the valve seating member; a connecting operating link between the bell-crank lever and the butterfly valve; float means at one end of the bell-crank lever and water impact flap means at the other end of the bell-crank lever whereby the butterfly valve may be pivoted into valve closing engagement with the seating member by the action of water flowing past the valve mechanism or by a float lifting action of water level relative to the float means. Conveniently bell-crank level travel limiting stops may be provided on the snorkel head pipe section above the seating member so as to arrest travel of the bell-crank lever at a butterfly valve fully open or fully closed position with respect to the valve seating member.

BRIEF DESCRIPTION OF THE DRAWINGS

The following is a description by way of example of an embodiment of the present invention reference being had to the accompanying drawings in which.

DESCRIPTION OF THE PREFERRED EMBODIMENT

A remote controlled robot submersible vehicle 10 of general submarine configuration has a marine diesel engine (not shown) driving a propeller 11 and having vehicle control surfaces 12, 13 and 14, similar to regular submarine control surfaces. A weighted keel 15 depends beneath the vehicle.

Figure 3:
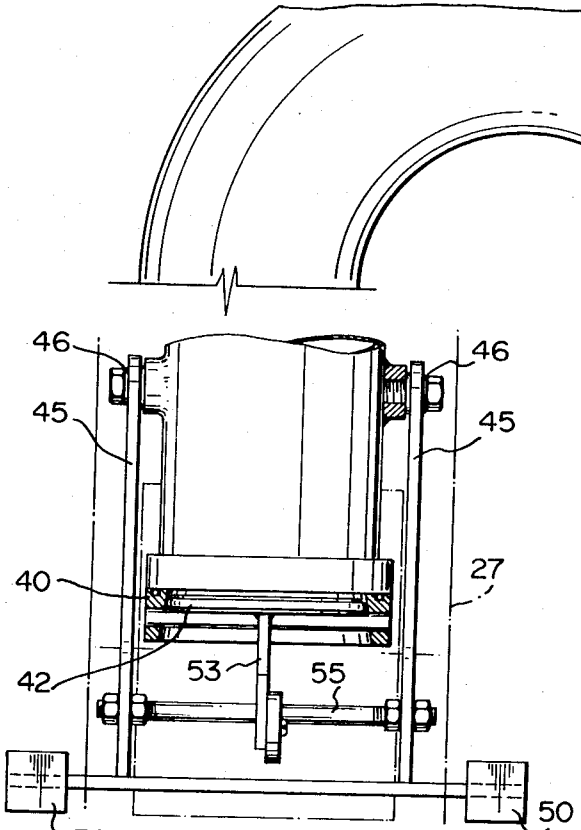
FIG. 3 is a detail of a snorkel valve closure device as viewed from the rear of the vehicle and looking towards its nose.

Extending upwardly from the vehicle is a snorkel mast 20 terminating at its upper end in a U-shaped head pipe section 21 (see particularly FIG. 3). A snorkel valve closing mechanism 22 provides for the opening and closing of the hollow snorkel tube 24 (which conveniently may be about 10 cm in diameter) extending within the mast and terminating at its lower end in an air-water separating device 26 which removes any water which is sucked into the air intake in the form of spray. The U-shaped snorkel head is enclosed in a fairly streamlined plastic casing 27 which is attached to the mast and which is provided with a series of air vents 28. A shaped slot 30 on either side of the casing 27 passes an impact flap 32 for operating the snorkel valve in a manner to be described more fully hereinafter.

The mast 20 is provided with a fairing 35 which comprises a plurality of segmented fairing elements 36 of substantially airfoil cross-section individually mounted for free rotation on the mast in water lubricated bearings. The fairing acts as an eddy shedding device and reduces cross-track "lift" on the mast 20 during high speed turns. The rolling moment is thus reduced and vehicle stability is maintained. If desired the mast may be provided with a forstay.

Figure 1:
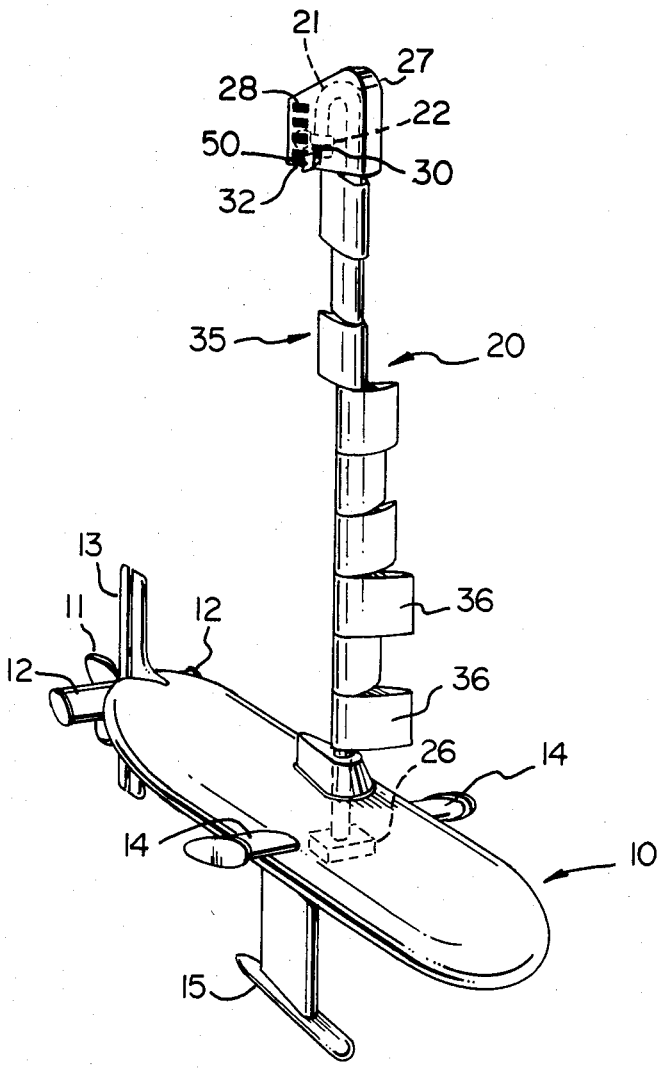
FIG. 1 is a pictorial illustration of a submersible vehicle mounting a snorkel mast in accordance with the embodiment of the invention.
Figure 2:
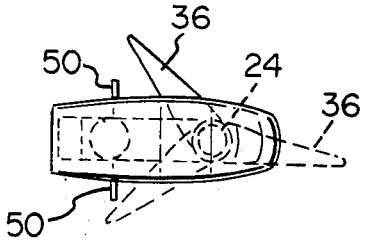
FIG. 2 is a view looking down on the mast of FIG. 1 from above.
Figure 4:
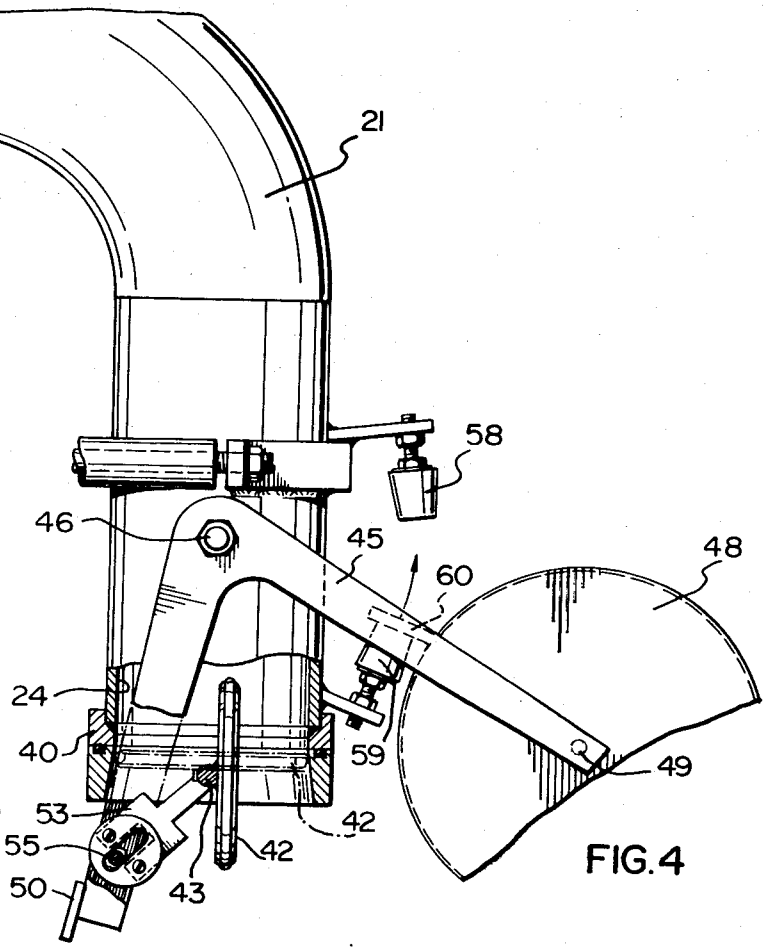
FIG. 4 is a side elevation of the valve closure mechanism shown in FIG. 3.

Turning now to FIGS. 3 and 4, the snorkel valve closure mechanism for the snorkel tube 24 is shown. A valve seating member 40 is affixed to the open end of the inverted U-shaped snorkel head pipe secton 21. A butterfly valve 42 is pivotally mounted at 43 to the seating member 40. A bell-crank lever 45 is pivotally mounted at 46 to the pipe section 21 above the valve seating member 40. A float 48 is attached at one end 49 of the bell-crank lever 45 and an impact flap 50 (one on either side of the mechanism) is mounted at the other end of the bell-crank lever and extends through the shaped slots 30 in the casing 27. A connecting linkage 53 is connected to the butterfly valve 42 at one end, and by means of a lost motion slot and pin arrangement 55 at its other end, to the bell-crank lever 45. A pair of limiting stops 58, 59 engage with a tongue 60 on the float 48 to limit travel of the bell-crank lever between a position where the butterfly valve is fully closed in sealing position (as seen in dotted lines in FIG. 4 or in full lines in FIG. 3) and a fully open position, as shown in full lines in FIG. 4.

In operation, when the submersible is deployed beneath the water (at about 3 meters) with its snorkel head section above the water level, wave activity, or other water disturbance, may cause the water surface level to move upwardly relative to the snorkel head. If water leaks into the casing 27 or enters through the air vents 28 the float 48 is activated to pivot the bell-crank lever about its pivot point 46 whereby to move the link 53 and pivot the butterfly valve 42 about its pivot 43 to close it. Similarly, if water flows past the outside of the casing 27 (say when a wave washes over the top of snorkel) it will engage the impact flaps 50 to rotate the bell-crank lever about its pivot 46 and close the butterfly valve 40. As water activity subsides the butterfly valve reopens and ventilates the vehicle again.

What I claim as my invention is:

1. A snorkel valve closure mechanism comprising a valve seating member mounted at the open end of an inverted U-shaped snorkel head pipe section; a butterfly valve pivoted at said open end; a bell-crank lever pivotally mounted on said snorkel head pipe section above said valve seating member; a connecting operating link between said bell-crank lever and said butterfly valve; float means at one end of said bell-crank lever and water impact flap means at the other end of said bell-crank lever whereby said butterfly valve may be pivoted into valve closing engagement with said seating member by the action of water flowing past said valve mechanism or by a float lifting action of water lever relative to said float means.

2. Apparatus as claimed in claim 1 wherein bell-crank lever travel limiting stops are provided on said snorkel head pipe section above said seating member whereby to arrest travel of said bell-crank lever at a butterfly valve fully open, or fully closed, position with respect to said valve seating member.

* * * * *